US006715526B1

(12) United States Patent
Brownfield et al.

(10) Patent No.: US 6,715,526 B1
(45) Date of Patent: Apr. 6, 2004

(54) CUBICLE DOOR

(76) Inventors: Roderick A. Brownfield, 249 Navigator Dr., Scotts Valley, CA (US) 95066; Richard R. Anderson, 107 Rockridge Ct., Santa Cruz, CA (US) 95060

( * ) Notice: Subject to any disclaimer, the term of this patent is extended or adjusted under 35 U.S.C. 154(b) by 0 days.

(21) Appl. No.: 10/331,871

(22) Filed: Dec. 30, 2002

(51) Int. Cl.[7] ..... A47G 5/02
(52) U.S. Cl. ..... 160/24; 160/242; 248/269
(58) Field of Search ..... 160/24, 242, 335, 160/334; 248/257, 265, 269

(56) References Cited

U.S. PATENT DOCUMENTS

| | | | | | |
|---|---|---|---|---|---|
| 193,573 | A | * | 7/1877 | Tripp | 160/25 |
| 930,554 | A | * | 8/1909 | Moody | 5/513 |
| 2,747,927 | A | * | 5/1956 | Burkhead | 296/97.8 |
| 3,203,467 | A | * | 8/1965 | Wulk | 160/24 |
| 3,321,164 | A | * | 5/1967 | Petrick | 248/171 |
| 3,989,213 | A | * | 11/1976 | Allen | 248/214 |
| 4,261,411 | A | | 4/1981 | Dieterich | |
| 5,275,220 | A | * | 1/1994 | Siegal | 160/24 |
| 5,419,015 | A | | 5/1995 | Garcia | |
| 6,253,826 | B1 | | 7/2001 | Witter et al. | |
| 6,330,898 | B1 | * | 12/2001 | Chang | 160/24 |
| 6,435,250 | B1 | | 8/2002 | Pichik et al. | |
| 6,601,638 | B1 | * | 8/2003 | Lafleur | 160/242 |

OTHER PUBLICATIONS

Printouts from cubedoor.com web site showing an office cubicle door. 2 sheets.

* cited by examiner

*Primary Examiner*—Blair M. Johnson
(74) *Attorney, Agent, or Firm*—Jack Lo

(57) ABSTRACT

A cubicle door is comprised of first and second brackets for wrapping over the top edges of a cubicle panel on opposite sides of the entry way. A roller blind has a proxiinal end hinged to the first bracket, and a distal end which is removably supported on a support attached to the second bracket. The end of the roller blind is received in either one of perpendicular grooves on top of the support. The grooves allow the roller blind to meet the second support at different fixed angles to fit the shape of the entry way. Alternatively, a rotatable turret with a notch is arranged on the second bracket. The roller blind is received in the notch, and the second bracket may be oriented at different angles relative to the roller blind by rotating the turret.

6 Claims, 6 Drawing Sheets

CUBICLE DOOR

BACKGROUND OF THE INVENTION

1. Field of the Invention

The invention broadly relates to rollup shades and doors.

2. Prior Art

Open offices typically have work spaces divided by partitions into cubicles. The partitions do not reach the ceiling, and the entries to the cubicles do not have doors. Such an open arrangement lacks privacy, and encourages frequent interruptions by co-workers that reduce productivity. Some workers resort to placing plants or bookcases in the entries to deter interruptions.

Light duty doors for cubicle entries are known among the prior art. For example, U.S. Pat. No. 6,253,826 to Witter et al and U.S. Pat. No. 6,435,250 to Pichik et al. disclose barriers which are pulled across the entry from one edge and secured to the other edge. Because of the tension in the barrier, brackets much be screwed or otherwise securely attached to the edges of the entry. The installation is inconvenient, and since it may leave holes on the edges of the entry, such devices may not be approved by the employer.

BRIEF SUMMARY OF THE INVENTION

Accordingly, objects of the present cubicle door are:

to deter interruptions;

to increase privacy;

to be installable within seconds;

to be installable without damaging the cubicle;

to be installable on cubicles with panels of different thickness;

to be installable on cubicles with different entry arrangements; and to be changeable for fitting cubicle entry ways of different widths.

The present cubicle door is comprised of first and second brackets for wrapping over the top edges of a cubicle panel on opposite sides of the entry way. The brackets are sized to fit the panel. Alternatively, the brackets are wide enough to fit panels of different thickness, and resilient pads on the inside of the brackets adapt to different panels. A roller blind has a proximal end hinged by a pivot to the first bracket. The roller blind has a distal end which is removably supported on a support attached to the second bracket. The end of the roller blind is received in either one of perpendicular grooves on top of the support. The grooves allow the roller blind to meet the second support at different fixed angles to fit the shape of the entry way. Alternatively, a rotatable turret with a notch is arranged on the second bracket. The roller blind is received in the notch, and the second bracket may be oriented at different angles relative to the roller blind by rotating the turret.

DRAWING REFERENCE NUMERALS

| | |
|---|---|
| 10. Bracket | 11. Bracket |
| 12. Top Edge | 13. Top Edge |
| 14. Panel | 15. Panel |
| 16. Entry Way | 17. Roller Blind |
| 18. Proximal End | 19. Pivot |
| 20. Arm | 20. Distal End |
| 22. Support | 23. Arm |
| 24. Groove | 25. Groove |
| 26. Extendable Sheet | 27. Bracket |
| 28. Bracket | 29. Resilient Pads |
| 30. Turret | 31. Notch |
| 32. Support | 33. Panel |
| 34. Panel | 35. Panel |
| 36. Panel | 37. Panel |
| 38. Panel | 39. Hinge Member |
| 40. Blind Housing | 41. End Member |

DETAILED DESCRIPTION OF THE INVENTION

Figure 1:
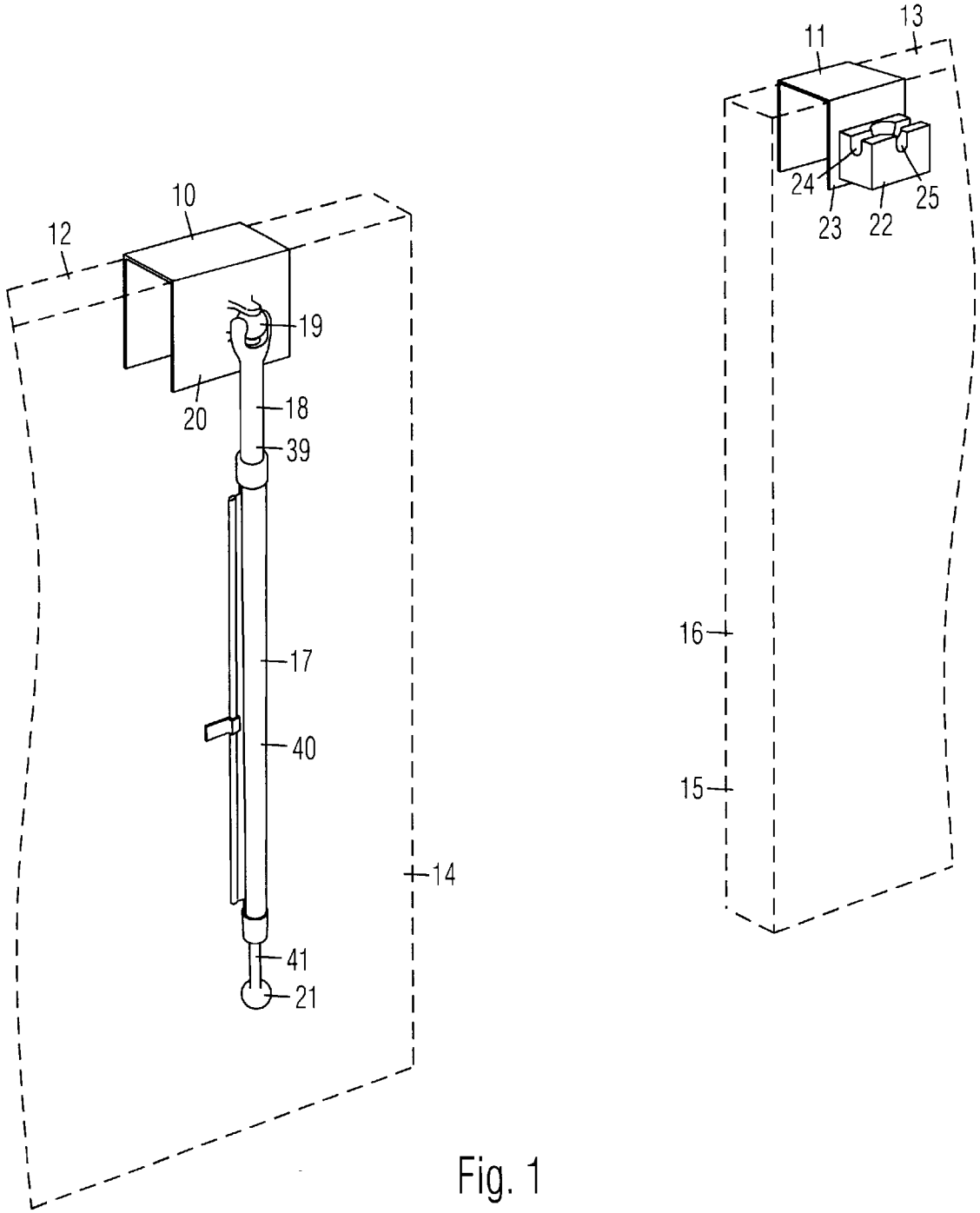
FIG. 1 is a front perspective view of the present cubicle door installed on a cubicle and in an open position.

FIG. 1:

In accordance with a first embodiment of the present cubicle door shown in FIG. 1, it is comprised of first and second C-shaped brackets 10 and 11 for wrapping over top edges 12 and 13 of cubicle panels 14 and 15 on opposite sides of an entry way 16. Brackets 10 and 11 are preferably placed on top of panels 14 and 15 without any fasteners, so that they are easy to install and remove.

A roller blind 17 has a proximal end 18 hinged by a pivot 19 to a vertical arm 20 of first bracket 10. Pivot 19 is preferably a 2-axis pivot, but it may have a single axis which is perpendicular to arm 20. Roller blind 17 is shown in a retracted and opened position for allowing people to pass through entry way 16. Roller blind 17 has a distal end 21 which may be removably supported on a support 22 attached to a vertical arm 23 on second bracket 22. Distal end 21 of roller blind 27 is received in either one of perpendicular grooves 24 and 25 on top of support 22. Grooves 24 and 25 allow roller blind 17 to meet second support 11 at different fixed angles to fit the shape of entry way 16.

Roller blind 17 is preferably comprised of a hinge member 39 detachably connected to a first end of a blind housing 40, and an end member 41 detachably connected to a second end of blind housing 40. Different length blind housing 40 may be attached between hinge member 39 and end member 41 for fitting cubicle entry ways of different widths. Hinge member 39 and end member 41 are preferably connected to blind housing 40 by snap fittings.

Brackets 10 and 11 may be reversed so that roller blind 17 is hinged to the right side of the cubicle entry way instead of the left side as shown. Also, brackets 10 and 11 may be arranged to position roller blind 17 on either the inside or outside of the cubicle.

Figure 2:
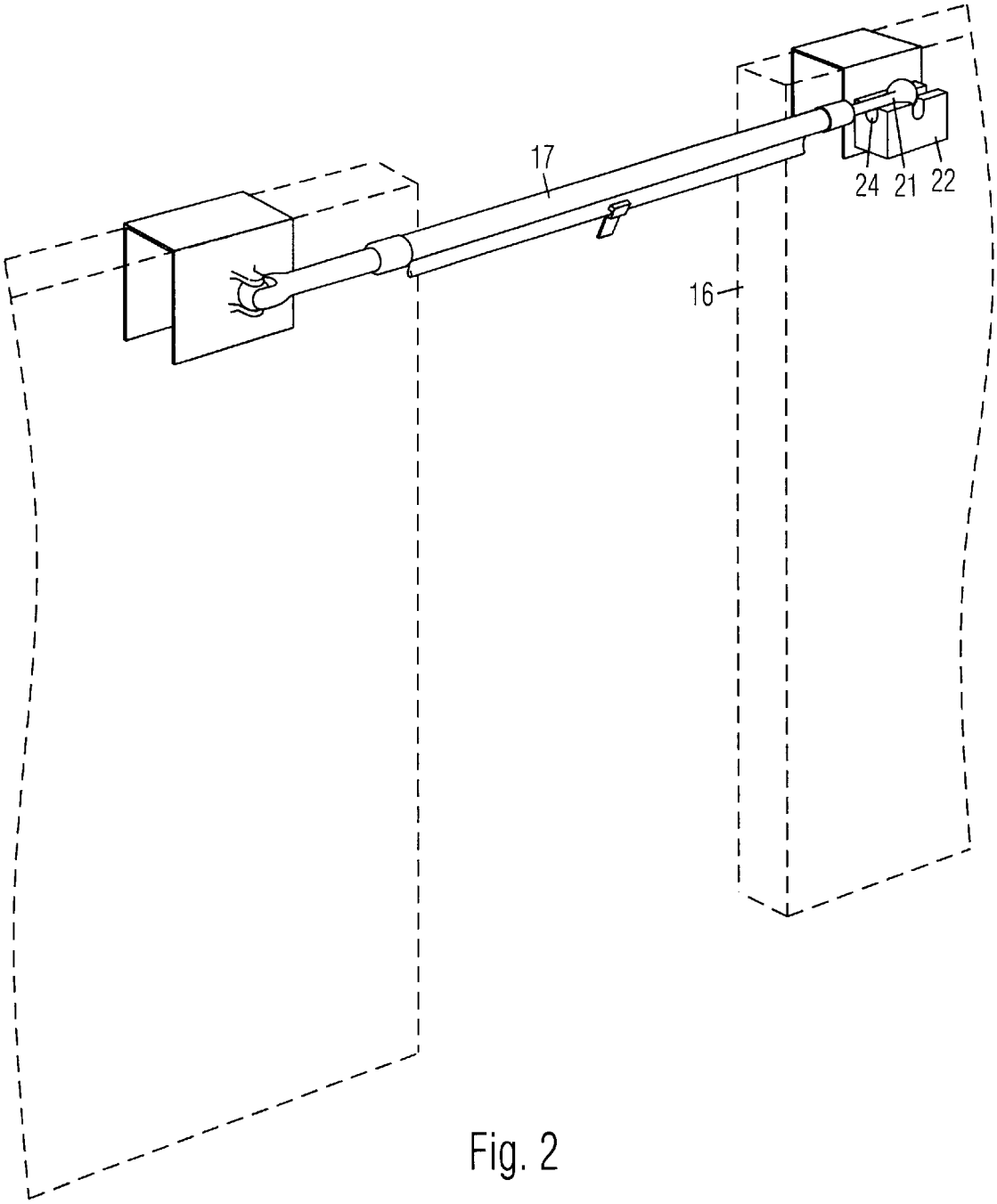
FIG. 2 is a front perspective view thereof when a roller blind is supported across an entry way of a cubicle.

FIG. 2:

To close entry way 16, roller blind 17 is pivoted to a horizontal position across entry way 16, as shown in FIG. 2. Distal end 21 of roller blind 17 is supported in groove 24 on support 22.

Figure 3:
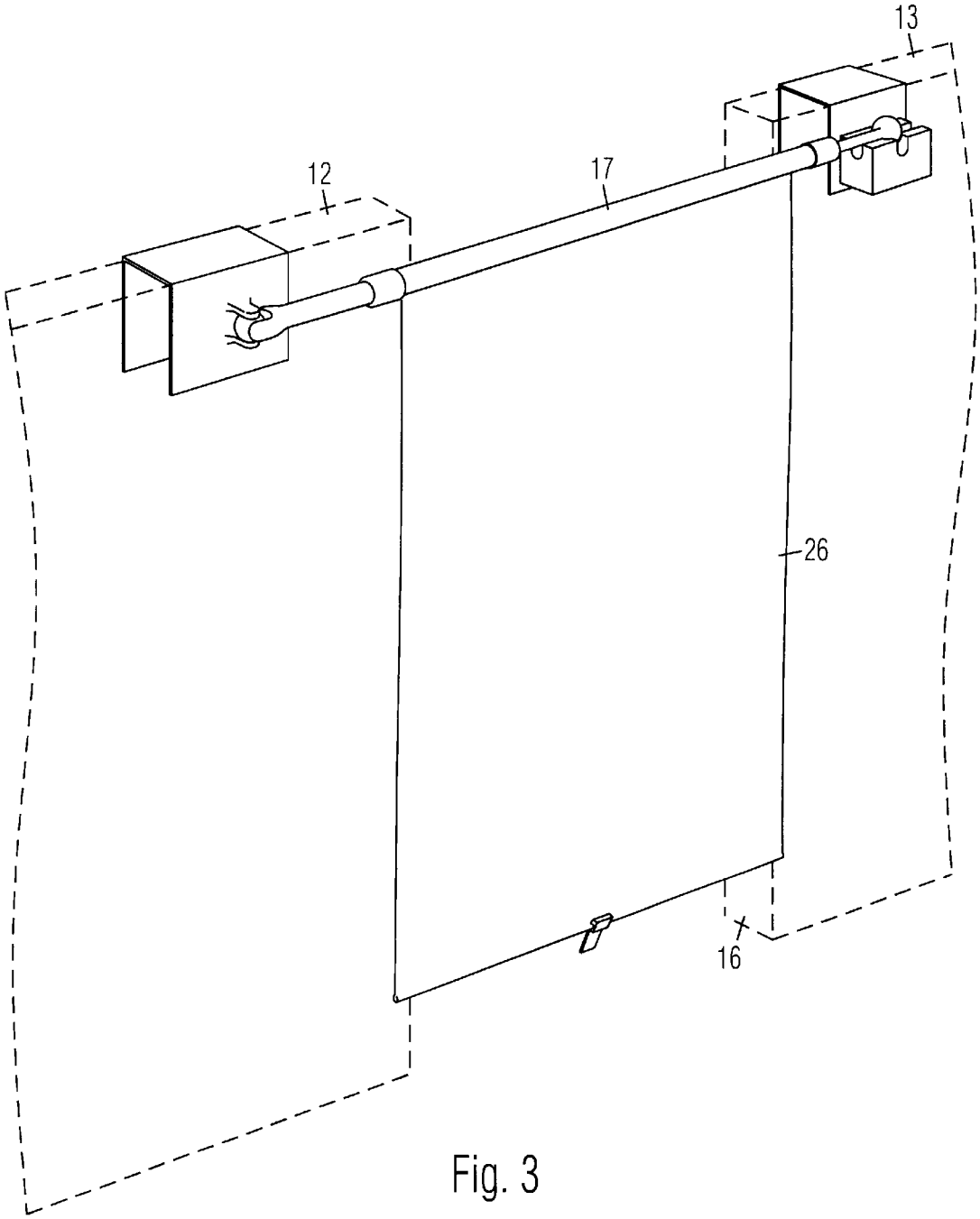
FIG. 3 is a front perspective view thereof when the roller blind is extended.

FIG. 3:

In FIG. 3, a retractable flexible sheet 26 is pulled down from roller blind 17, which is preferably of the type which is arranged to stay extended when sheet 26 is released. Alternatively, roller blind 17 may be of the type that requires an anchor to hook onto to stay extended. A pair of anchors (not shown) may be attached to panels 12 and 13 on opposite sides of entry way 16. When retractable sheet 26 is extended, entry way 16 is blocked to increase privacy and avoid interruptions by coworkers.

To open entry way 16, retractable sheet 26 is retracted into roller blind 17 before roller blind 17 is disconnected from second bracket 11. Roller blind 17 is preferably of the type which retracts sheet 26 when sheet 26 is pulled. Alternatively, roller blind 17 may be of the type which retracts sheet 26 when a button (not shown) on roller blind 17 is pressed.

Figure 4:
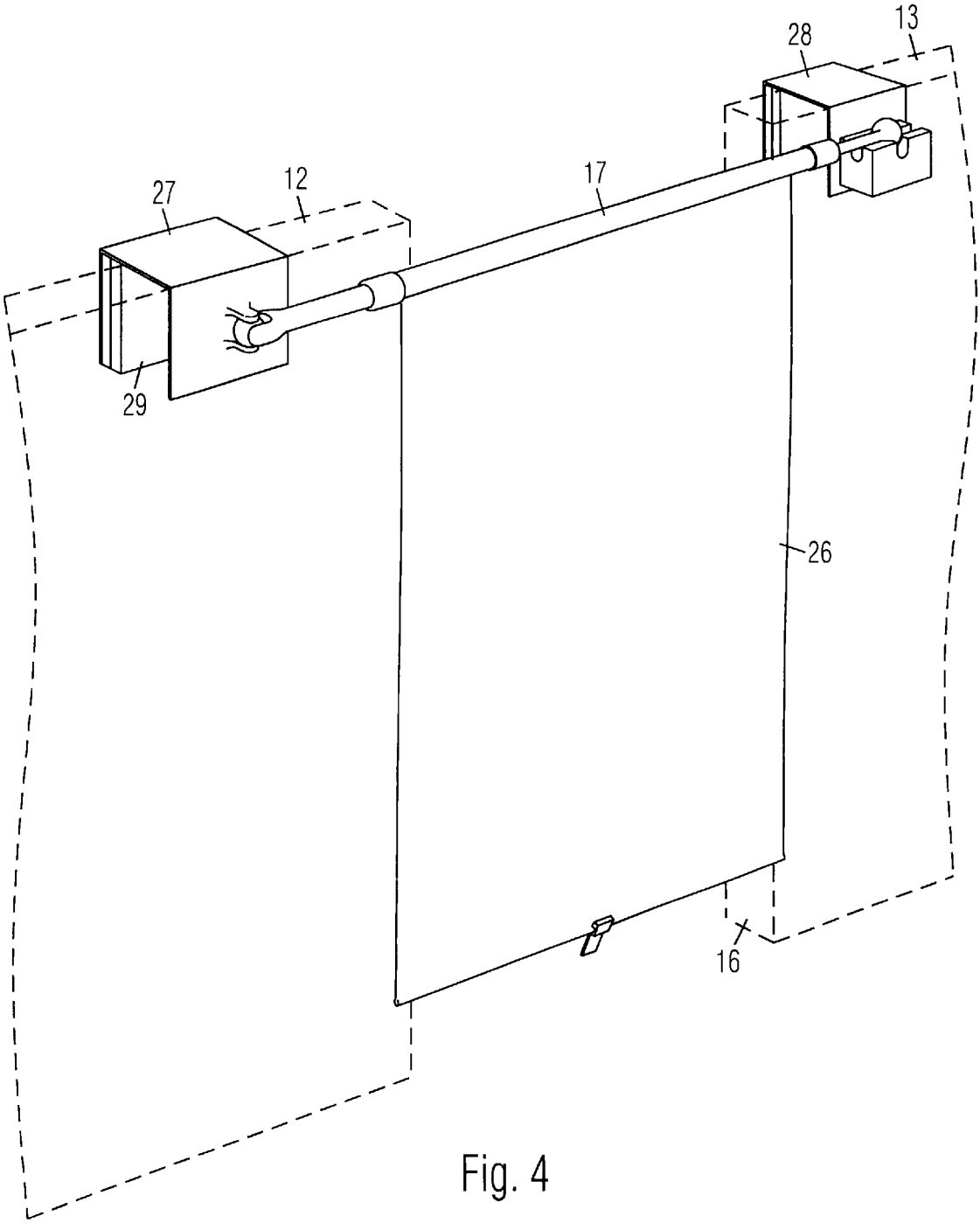
FIG. 4 shows an alternative embodiment with adaptable brackets.

FIG. 4:

A second embodiment of the cubicle door is shown in FIG. 4. It includes brackets 27 and 28 which are wide enough to fit panels of different thickness, and vertical resilient pads 29 on the inside of brackets 27 and 28 for adapting to different panels thickness. A plurality of pads 29 are preferably provided and inserted as needed for adjusting to different panels. Pads 29 are preferably self-adhesive for mounting to brackets 27 and 28.

Figure 5:
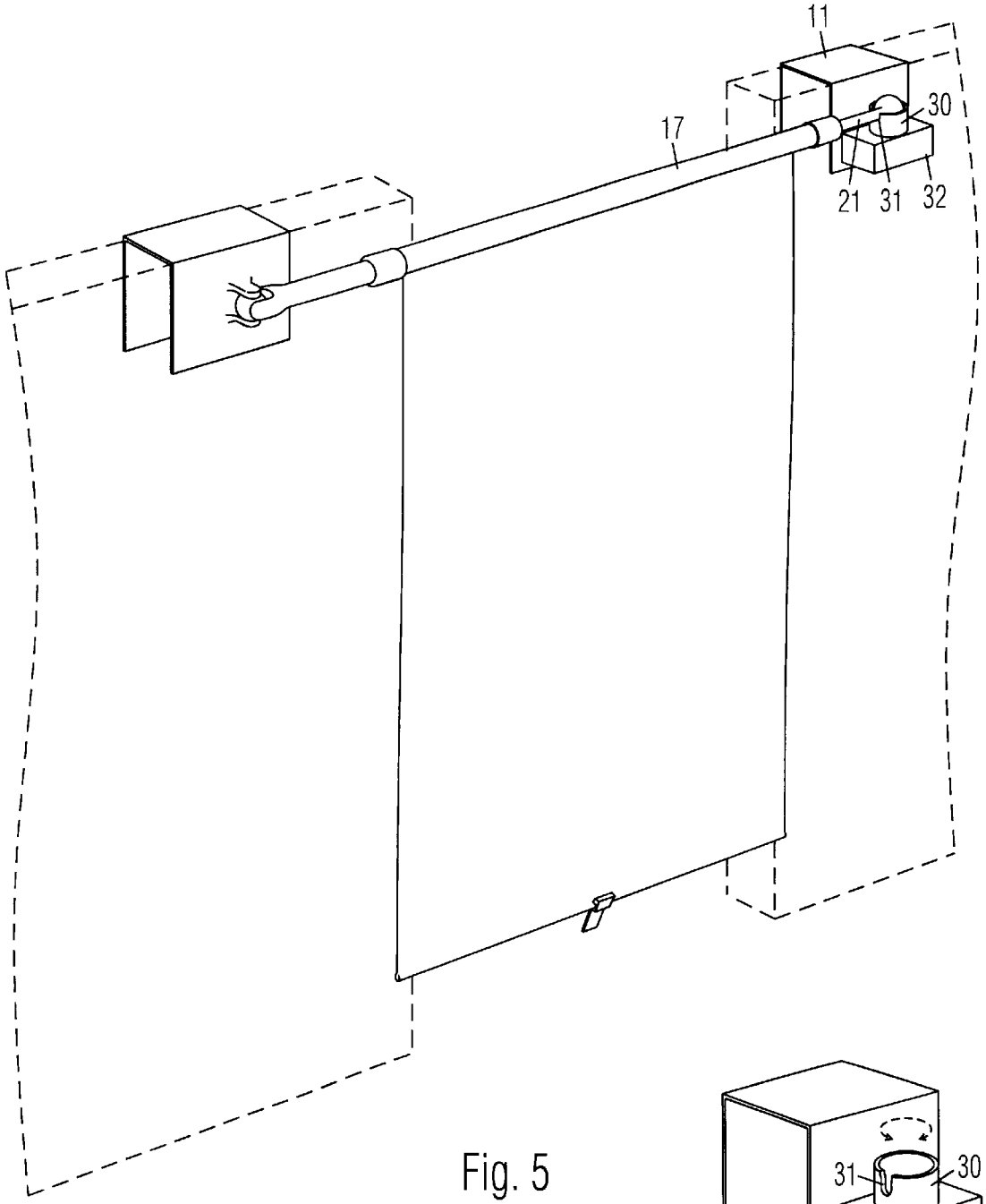
FIG. 5 shows another alternative embodiment with a rotatable turret receiving the roller blind.

FIG. 5:

Alternatively, a rotatable turret 30 with a notch 31 is arranged on a support 32 of second bracket 11, as shown in FIG. 5. Turret 30 may also be attached to second bracket 28 (FIG. 4). Distal end 21 of roller blind 17 is received in notch 31. Second bracket 11 may be oriented at different angles relative to roller blind 17 by rotating turret 30.

Figure 6:
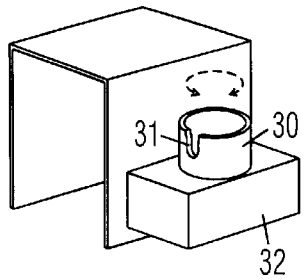
FIG. 6 shows an enlarged view of the turret in FIG. 5.

FIG. 6:

An enlarged view of turret 30 is shown in FIG. 6. Turret 30 is rotatable about a vertical axis as indicated by the dashed arrows.

Figure 7:
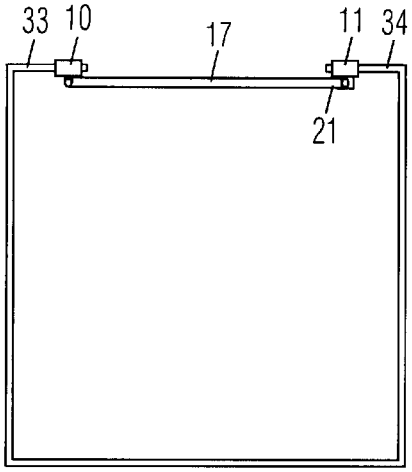
FIG. 7 is a top view of the cubicle door on a cubicle with aligned panels on either side of a front entry way.
Figure 8:
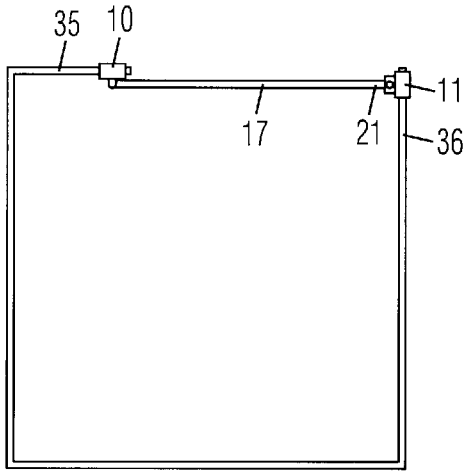
FIG. 8 is a top view of the cubicle door on a cubicle with perpendicular panels on either side of a front entry way.
Figure 9:
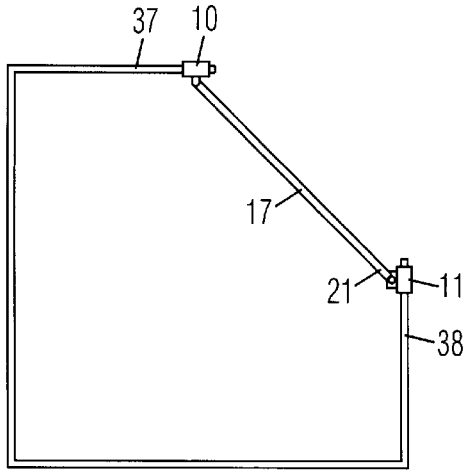
FIG. 9 is a top view of the cubicle door on a cubicle with perpendicular panels on either side of a corner entry way.

FIGS. 7–9:

Distal end 21 of roller blind 17 may be supported at different angles on second bracket 11, either in perpendicular grooves (FIG. 1), or in rotatable turret (FIG. 5), to enable the cubicle door to fit different types of entry ways. In FIG. 7, brackets 10 and 11 are attached to parallel panels 33 and 34 adjacent a side entry way. In FIG. 8, brackets 10 and 11 are attached to perpendicular panels 35 and 36 adjacent a side entry way. In FIG. 9, brackets 10 and 11 are attached to perpendicular panels 37 and 38 adjacent a comer entry way. Additional arrangement are possible.

Although the foregoing description is specific, it should not be considered as a limitation on the scope of the invention, but only as an example of the preferred embodiment. Many variations are possible within the teachings of the invention. For example, different attachment methods, fasteners, materials, dimensions, etc. can be used unless specifically indicated otherwise. The relative positions of the elements can vary, and the shapes of the elements can vary. Therefore, the scope of the invention should be determined by the appended claims and their legal equivalents, not by the examples given.

I claim:

1. A cubicle door, comprising:

a C-shaped first bracket and a C-shaped second bracket for wrapping over top edges of adjacent cubicle panels on opposite sides of a cubicle entry way; and a roller blind with a proximal end hinged to said first bracket, and a distal end removably supported on a support attached to said second bracket, wherein said roller blind is movable between a vertical open position disconnected from said second bracket and hanging from said first bracket, and a horizontal closed position across said entry way supported by said second bracket, wherein said roller blind includes a flexible sheet which is extendable into a flat panel when said roller blind is in said closed position across said entry way, and retractable into a roll to enable said roller blind to be disconnected from said second bracket to open said entry way.

2. The cubicle door of claim 1, further including respective resilient pads inside said first bracket and said second bracket for adapting to walls of different thickness.

3. A cubicle door, comprising:

a C-shaped first bracket and a C-shaped second bracket for wrapping over top edges of adjacent cubicle panels on opposite sides of a cubicle entry way; and a roller blind with a proximal end hinged to said first bracket, and a distal end removably supported on a support attached to said second bracket, wherein said support includes intersecting grooves arranged to receive said distal end of said roller blind at different angles, so as to enable said second bracket to be positioned at different angles relative to said first bracket for attaching to entry ways of different shapes; wherein said roller blind is movable between a vertical open position disconnected from said second bracket and hanging from said first bracket, and a horizontal closed position across said entry way supported by said second bracket, wherein said roller blind includes a flexible sheet which is extendable into a flat panel when said roller blind is in said closed position across said entry way, and retractable into a roll to enable said roller blind to be disconnected from said second bracket to open said entry way.

4. The cubicle door of claim 3, further including respective resilient pads inside said first bracket and said second bracket for adapting to walls of different thickness.

5. A cubicle door, comprising:

a C-shaped first bracket and a C-shaped second bracket for wrapping over top edges of adjacent cubicle panels on opposite sides of a cubicle entry way; and a roller blind with a proximal end hinged to said first bracket, and a distal end removably supported on a support attached to said second bracket, wherein said support includes a rotatable turret with a notch arranged to receive said distal end of said roller blind, said turret is rotatable to position said notch at different angles relative to said second bracket, so as to enable said second bracket to be positioned at different angles relative to said first bracket for attaching to entry ways of different shapes; wherein said roller blind is movable between a vertical open position disconnected from said second bracket and hanging from said first bracket, and a horizontal closed position across said entry way supported by said second bracket, wherein said roller blind includes a flexible sheet which is extendable into a flat panel when said roller blind is in said closed position across said entry way, and retractable into a roll to enable said roller blind to be disconnected from said second bracket to open said entry way.

6. The cubicle door of claim 5, further including respective resilient pads inside said first bracket and said second bracket for adapting to walls of different thickness.

* * * * *